United States Patent [19]

Humiston

[11] Patent Number: 5,067,889

[45] Date of Patent: Nov. 26, 1991

[54] SEAM KNIFE FOR DRY WALL

[76] Inventor: Robert R. Humiston, 134 Woodside La., Liverpool, N.Y. 13090

[21] Appl. No.: 573,252

[22] Filed: Aug. 27, 1990

[51] Int. Cl.[5] ..... B05C 17/10

[52] U.S. Cl. ..... 425/458; 15/235.7

[58] Field of Search ..... 15/235.4, 235.7, 235.8; 425/458, 87

[56] References Cited

U.S. PATENT DOCUMENTS 2,247,603 7/1941 Christman ..... 425/458
2,914,798 12/1959 Lausman ..... 425/458
4,757,572 7/1988 Yon ..... 425/458
4,919,604 4/1990 Wilson ..... 425/458
4,946,360 8/1990 Brown ..... 425/458

*Primary Examiner*—Jay H. Woo
*Assistant Examiner*—Robert B. Davis
*Attorney, Agent, or Firm*—Wall and Roehrig

[57] ABSTRACT

A tool used to work joint compound into a wide angle corner formed by two abutting wallboard panels. The blade is formed of flexible sheet metal that is contoured so that it can be pressed into a wide angle corner to work joint compound into the corner seam and close the joint in a rapid and efficient manner.

5 Claims, 2 Drawing Sheets

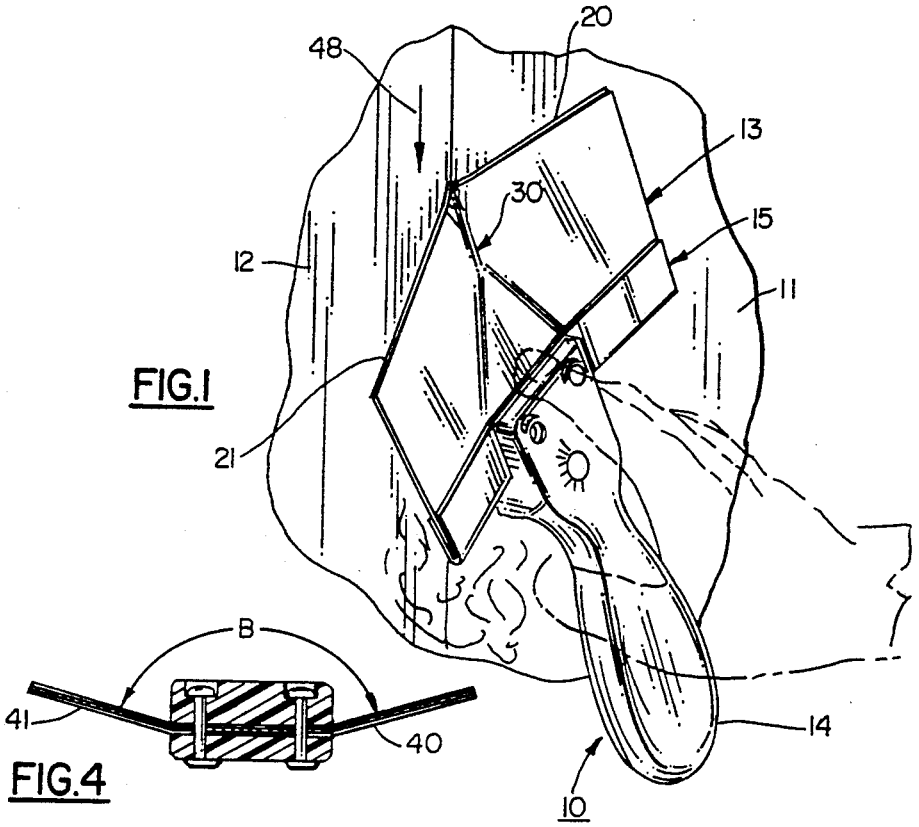
FIG.1
FIG.4
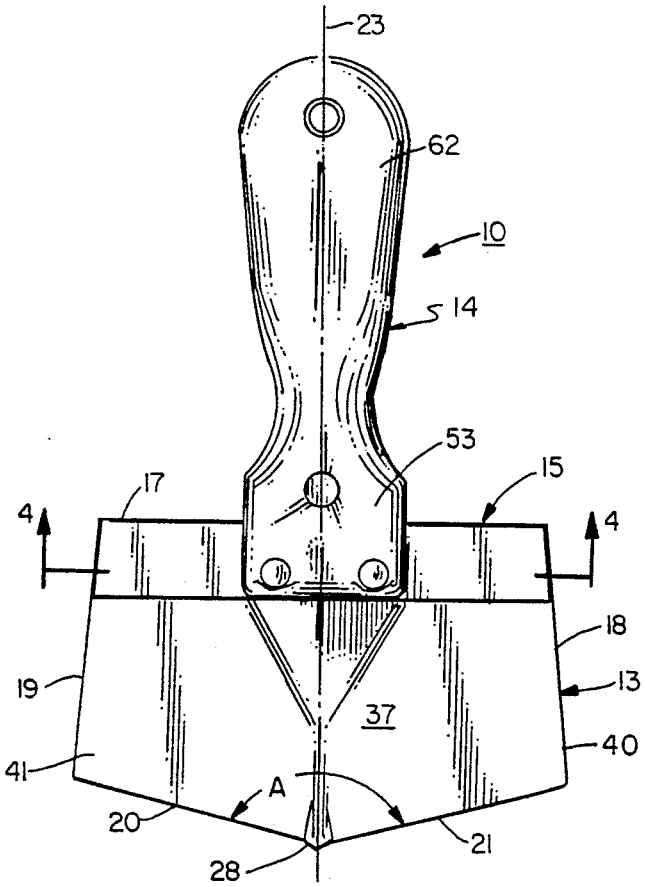
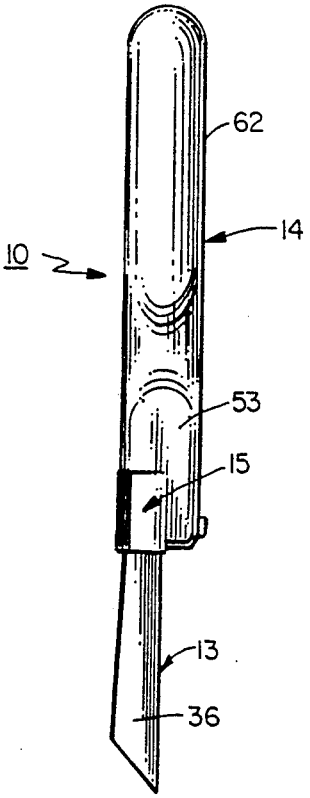

SEAM KNIFE FOR DRY WALL

BACKGROUND OF THE INVENTION

This invention relates to a tool used to create a joint along the seam of a corner formed by two abutting dry wall panels which form an angle that is greater than ninety degrees.

Predominantly, in dry wall construction, corners are usually about ninety degrees. However, in some types of interiors, corner angles may be considerably greater and pose certain difficulties when closing the seam between the panels. Typically, dry wall seams are closed using a joint compound and joint tape that are worked into the seam area to fill the space between the panels to create a smooth appearing surface for receiving paint or any other suitable wall covering.

An experienced dry wall finisher can close a flat seam between panels, or a ninety degree corner, quickly and efficiently using tools presently available in the trade. However, no tools are available for specifically dealing with wide angle corners and, as a consequence, a great deal of time and effort is wasted in finishing this type of corner joint even by the most skilled workers. This leads to an increase in construction costs.

SUMMARY OF THE INVENTION

An object of the present invention is to improve tools used in closing wide angle corners in dry wall construction.

A still further object of the present invention is to provide a dry wall finishing tool which can be used to rapidly and efficiently close a wide angle corner formed by two abutting panels.

Another object of the present invention is to provide a dry wall tool that will enable someone less than a highly skilled worker to form a quality joint in a wide angle dry wall corner.

Yet another object of the present invention is to reduce the cost of dry wall construction.

These and other objects of the present invention are attained by means of a corner closing tool that includes a thin flexible blade having a top edge, two opposed side edges and a pair of bottom edges that meet at the center of the blade to create a point having an inside or included angle of between 140° and 160°. The blade is bent along a Y-shaped bend line lying along the central axis thereof to create two angularly offset wings that are slanted upwardly from the rear face of the blade towards its front face. The two wings form an interior angle of between 140° and 160°. In use, the blade is centered in a wide angled corner and pressed into conformity with the corner forming panels.

BRIEF DESCRIPTION OF THE DRAWINGS

For a better understanding of these and other objects of the present invention, reference should be made to the following detailed description of the invention which is to be read in association with the following drawings wherein:

FIG. 1 is a perspective view showing the tool of the present invention being used to close a corner joint between two sheets of dry wall;

FIG. 2 is a front view of the tool shown in FIG. 1;

FIG. 3 is a side view of the tool;

FIG. 4 is a sectional view taken along line 4—4 in FIG. 2; and

DESCRIPTION OF THE INVENTION

Figure 5:
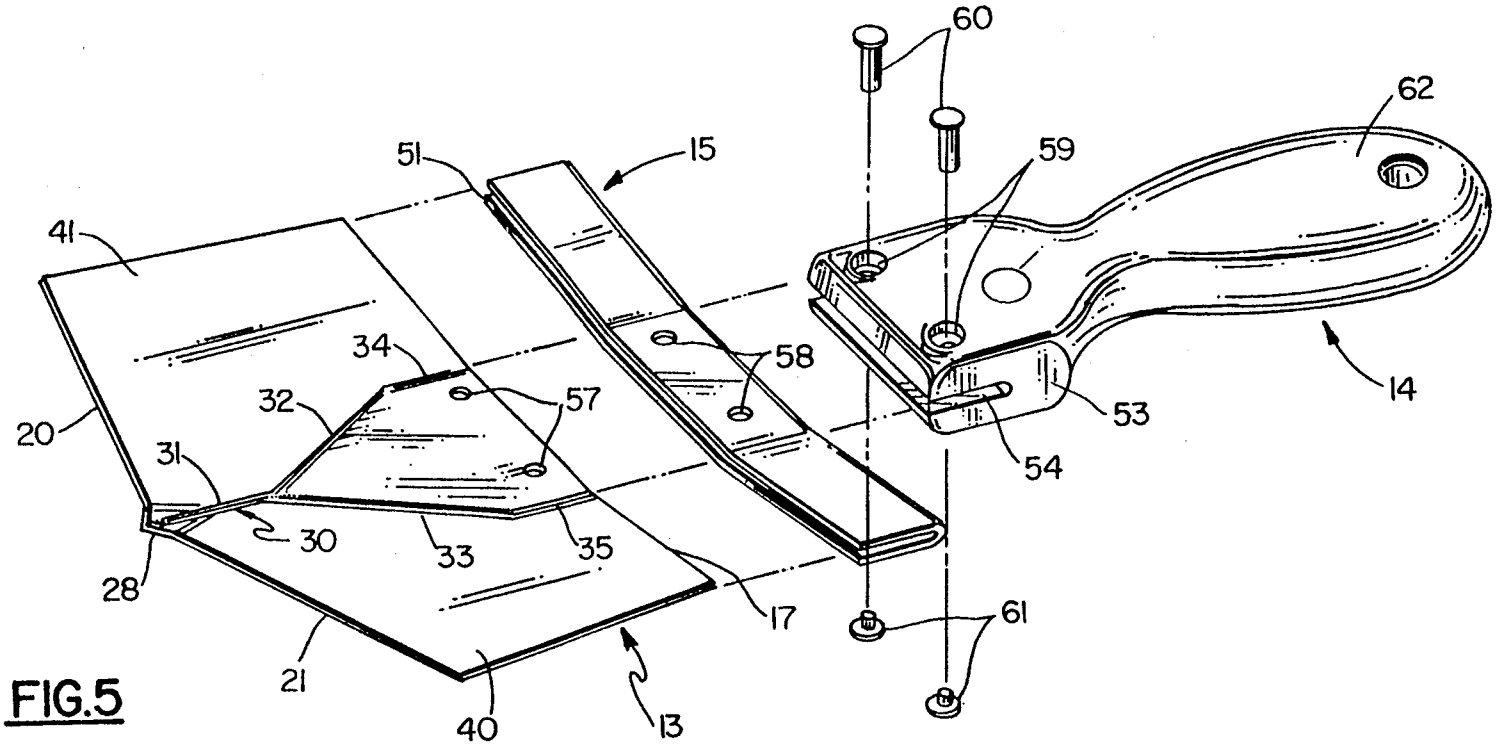
FIG. 5 is an exploded view in perspective showing the parts of the tool.

Turning now to the drawings, there is illustrated a dry wall tool, generally designated 10, which is ideally well suited for use in closing the joint between two wallboard panels 11, 12 where the interior angle between the two panels is between 140° and 160°. This type of corner will herein be referred to as a wide angle corner. As noted above, the seam between the panels is first tightly packed with a joint compound and while the compound is still wet, a strip of suitable joint tape, which is generally paper, is placed in the compound along the length of the seam. The tape is worked into the compound to remove all wrinkles and a second layer of compound is placed over the strip and allowed to dry. Once dry, the joint compound is sanded smooth. If required, a finishing layer of compound may be placed over the smoothed surface which is again sanded before sealing and painting.

Ordinarily, when the seam is between two flat panels lying in the same plane, the compound and strip material can be worked with a flat faced blade to rapidly and efficiently finish the joint. Special tools are also available for finishing standard 90° corners. These special tools all take more or less the same form, wherein two perpendicularly aligned, flat-faced blades are joined together in a shape that complements the corner. No tools, however, are presently available for working wide angle corners, that is, corners having interior angles of between 140° and 160°.

The present tool includes a blade 13, a handle 14 and a blade stiffener 15. The blade preferably is formed from a single sheet of relatively thin, resilient steel having sufficient flexibility so that the blade will flex when pressed into a corner as shown in FIG. 2. The blade portion of the tool has a linear top edge 17 and a pair of opposed side edges 18 and 19 and two angularly offset bottom edges 20 and 21 which intersect at the central axis 23 of the tool to form a point 28. Each bottom edge forms an angle of between 70° and 80° with the axis of the blade so that the interior angle (A) between the edges is about between 140° and 160° with an angle of 150° being preferred.

The blade is bent along a Y-shaped bend line 30 having a center vertical leg 31 aligned with the axis 23 of the blade. The leg extends upward from the point 28 of the blade to about the mid-section of the blade. The legs 32 and 33 of the bend line diverge uniformly from the leg 31 and extend upwardly toward the top edge 17 of the blade before turning upwardly in a vertical direction at 34 and 35 (FIG. 5). The blade on both sides of the bend line is bent uniformly from the back face 36 toward the front face 37 of the blade to form a pair of symmetrical wings 40 and 41. As best seen in FIG. 4, an interior angle (B) of between 140° and 160° is formed by the two upraised wings, with an angle of 150° being preferred.

As can be seen, the bottom edges of the wings are swept upwardly from the point 28 toward the side edges 18, 19 while at the same time folding outwardly from the back face of the blade toward the front face. Accordingly, when the blade is flexed into a wide angle corner as shown in FIG. 1, the blade can be drawn in the direction of the arrow to either smooth the joint compound in the corner or to flatten the joint tape into the seam. The two bottom edges of the blade are bevelled slightly with the bevel sloping from the back face of the blade toward the front face to enhance the tool's ability to work the compound.

Stiffening member 15 is mounted along the top edge of the blade to provide added rigidity to this section. The member is formed from a single sheet of steel that is bent into a U-shaped configuration that complements the shape of the blade. The top edge of the blade is slipped into the open end of the stiffener and is held therein either by mechanically pressing the abutting surface into locking contact or spot welding them together.

Handle 14 has a base section 53 in which a slot 54 is formed. The stiffener and blade assembly are slidably received within the slot. Aligned rivet holes 57, 58 and 59 are provided in the blade, the stiffener and the base section of the handle, respectively. Rivets 60—60 are received in the holes and heads 61—61 are joined to the rivets to secure the three elements of the tool in assembly. The shank 62 of the handle extends outwardly from the blade and is contoured to provide a secure hand grip.

While the invention has been described in the specification and illustrated in the drawings with reference to the preferred embodiments, it will be understood by those skilled in the art that various changes may be made and equivalents may be substituted for elements of the invention without departing from the scope of the claims. In addition, many modifications may be made to adapt a particular situation or material to the teachings of the invention without departing from the essential scope thereof. It is intended that the invention not be limited to the particular embodiments illustrated by the drawings and described in the specification as the best mode presently contemplated for carrying out this invention, but that the invention will include any embodiments falling with the description of the claims.

What is claimed is:

1. A dry wall tool for closing wide angle shallow corners at a joint between two abutting sheets of dry wall that includes, a thin flexible blade having a front face and a back face, said blade further having a linear top edge, two opposed side edges, and a pair of angularly disposed bottom edges that meet at the central axis of the blade to form a point which has an included angle of between 140° and 160°, said blade being bent from the back face toward the front face along a Y-shaped bend line to form a pair of angularly offset wings, said bend line having a center leg lying upon the central axis of the blade and extending upwardly from said point to about the mid-region of the blade and a pair of outwardly diverging arms that extend upwardly toward the top edge of the blade, said wings having an interior angle of between 140° and 160°, and a handle secured to the blade in the region between the upraised arms of said bend lines, said handle extending outwardly beyond the top edge of the blade to provide a hand grip for the tool.

2. The dry wall tool of claim 1, that further includes a stiffening means mounted along the top edge of the blade.

3. The dry wall tool of claim 1, wherein the bottom edge of the blade is bevelled from the back face of the blade toward the front face.

4. The dry wall tool of claim 1, wherein the handle is secured to the blade by rivet means.

5. The dry wall tool of claim 1 wherein the blade is constructed of a flexible steel sheet that is capable of being resiliently deformed when pressed into a wide angle corner to conform to the shape of the corner.

* * * * *